US005509359A

United States Patent [19]

Houston

[11] Patent Number: 5,509,359

[45] Date of Patent: Apr. 23, 1996

[54] PEDESTAL LINER SYSTEM FOR LOCOMOTIVES

[76] Inventor: Stanley M. Houston, 930 Detroit Ave., Ste. A, Concord, Calif. 94518

[21] Appl. No.: 304,831

[22] Filed: Sep. 13, 1994

[51] Int. Cl.[6] ..... B61F 5/32

[52] U.S. Cl. ..... 105/225; 411/3; 411/427

[58] Field of Search ..... 105/218.1, 220, 105/224.05; 411/2, 3, 427, 410

[56] References Cited

U.S. PATENT DOCUMENTS

| | | | |
|---|---|---|---|
| 3,554,618 | 1/1971 | Ditzler et al. | 105/225 |
| 4,170,180 | 10/1979 | Houston | 105/225 |
| 4,333,404 | 6/1982 | Kleykamp | 105/225 |
| 4,825,777 | 5/1989 | Cummins | 105/225 |
| 4,964,346 | 10/1990 | Kirilloff et al. | 105/218.1 |
| 5,092,797 | 3/1992 | Cole et al. | 411/2 |

FOREIGN PATENT DOCUMENTS

| | | | |
|---|---|---|---|
| 1490954 | 8/1967 | France | 411/3 |
| 2011739 | 9/1971 | Germany | 411/3 |

*Primary Examiner*—Robert Oberleitner
*Assistant Examiner*—S. Joseph Morano
*Attorney, Agent, or Firm*—Joseph L. Strabala

[57] ABSTRACT

An improved sliding bearing system for railroad locomotives having pedestal legs includes a channel-shaped unit of a wear resistant thermoplastic, including a base and two upstanding flanges ported with mounting apertures, plus two inserts made of strips of a more resilient thermoplastic, with one of the inserts mounted in the base adjacent to one of the flanges and the other insert mounted in the base adjacent to the other flange, so they are operable to compress and expand under loading variations, along with fastening members with undersized bosses relative to the diameter of the apertures in the flanges, operable to secure the unit to the pedestal leg in a manner that its flanges will slip on the associated pedestal leg under loading variations to accommodate the resiliency of the inserts, enabling the unit to shift on the face of the leg to better distribute the loading on the unit more uniformly, whereby the service life of the unit is extended.

8 Claims, 5 Drawing Sheets

PEDESTAL LINER SYSTEM FOR LOCOMOTIVES

BACKGROUND OF THE INVENTION

The present invention relates to improvements in wear surfaces for the trucks of railroad locomotives. More particularly, the invention relates to an improved bearing system between those portions of such trucks, which are slidably disposed to one another to enable the wheels and the body of the vehicle to move relative to each other in a vertical direction, while providing horizontal containment for the wheel axle.

A conventional locomotive is supported on a truck, which is composed of a single casting with integral pedestal jaws, that are spaced apart and connected together by a transverse member. This type of truck is often referred to as a pedestal truck. The pedestals are part of the jaws and form inverted U-shaped sections so a journal box at each end of the wheel axle can be received between the legs of the jaws, suspending a journal box therebetween on each side the truck, so each box can move vertically in relationship to the truck, while being retained against horizontal displacement. These trucks may contain up to three sets of jaws. Rubbing contact between the vertical surfaces of each box and its contiguous legs of the jaws results from this arrangement.

Two downwardly facing fingers on truck the form an inverted U, which are called the pedestal legs and the space between them is the open jaw. Each truck has two open jaws, or a set of jaws, and may have up to three sets of open jaws. Each open jaw is closed at its bottom by a pedestal tie bar after the journal box is received in the open jaw. In this manner, the journal boxes are positioned within the open jaws in a vertical sliding relationship within the truck. As the locomotive body is supported by the truck assembly, this arrangement allows vertical movement between the locomotive body and the journal boxes on which the wheels are mounted, and which have springs between the boxes and the truck.

Rapid wear occurs at the vertical interfaces between the pedestal legs and each journal box, due to the high horizontal loadings under acceleration and deceleration. Thus, wear plates are normally attached to one or more of the opposing faces on the pedestal legs and journal boxes to reduce the wear and protect the underlying parts. The wear plates attached to the pedestal legs are commonly referred to as pedestal liners and are the subject matter of the present invention.

Originally the pedestal liners were made of hardened steel. More recently they have been made from thermoplastics, such as nylon, because such materials last much longer than the hardened steel components previously used.

One pedestal liner, shaped like the original steel liner, now in use, is produced by a monolithic nylon casting process. However, the resulting castings proved less serviceable than injection molded pedestal liners because they have minimal shock absorbing properties, coupled with a high breakage rate. Cast liners of this type are disclosed in U.S. Pat. No. 3,554,618 to Ditzler et al.

Ditzler also obtained U.S. Pat. No. 4,094,253 on a floating pedestal liner constructed of cast nylon. This liner design has no attachment to its associated pedestal leg, allowing it to float on both the pedestal leg and on the wear surface of the journal box. Ostensibly due to the movement of the loose or floating liner between the legs and the journal box, this design has a low longevity. As a result, this design was not generally adopted by the railroad industry.

In Houston's U.S. Pat. No. 4,170,180, spacing washers are employed with bolts used to attach nylon pedestal liners to the pedestal legs. These washers are designed to limit the amount of compression placed on the nylon liner by the attaching bolts, thereby preventing cold flow of the nylon in the liner, due to the compression thereof by the attaching bolts.

Such cold flow often causes the liner's wear surface to move away from the faces of the pedestal leg, resulting in poor liner performance and breakage, because of a resulting gap between the pedestal liner and the pedestal leg. Typically a space of about one-sixteenth of an inch is common when cold flow occurs in nylon liners without the spacing washers, such a gap, as well as larger ones, reduce the service life for the pedestal liner. It is also believed that impact abrasion occurs on the surface supporting the liner, and is increased when gaps exists between the liner and the leg face, damaging the face of the leg. Further, misaligned bolt holes may also contribute to the gap between these parts.

While the liners built according to U.S. Pat. No. 4,170,180 provide a superior wear plate, a problem still exists with all nylon pedestal liners due to concentrated localized loading, on the their edges, such as occurs when a locomotive negotiates a tight curve in the tracks. Since the wheels on the axle are fixedly joined together, the difference in wheel travel of the inside wheel in relation to the outside wheel during travel around a curve will move one journal box forward and the other rearward relative to the jaw. As a small gap exists between the pedestal liner and the wear face on the journal boxes, the axle will skew enough to substantially increase the edge load on the outside edges of the liners, during these conditions.

Maintenance records indicate locomotives having twisting track systems (many tight curves) obtain a much shorter service life from thermoplastic pedestal liners. This is a problem addressed by the novel system of this invention which, under experimental test, shows a substantial increase in service life, even under the most extreme operating conditions.

SUMMARY OF THE INVENTION

An improved sliding bearing system for railroad locomotive trucks includes a channel-shaped unit of a wear resistant thermoplastic, having a rectangular base with two upstanding side flanges having mounting apertures therein, along with at least one insert strip of a more resilient thermoplastic mounted on the base between the flanges and operable to compress and expand under loading changes, and a fastening member having a T-shaped nut on each end, each nut having an undersized boss relative to the diameter of the mounting apertures in the flanges, and a circular flange at its top with a shank connecting the T-shaped nuts operable to mount the unit on a pedestal leg of a truck, so the unit will dynamically shift on the leg to better distribute the loading on the wear surface of the liner due to the resiliency of the strip.

Also inserts of increased widths can be used in railroad trucks already exhibiting significant wear in the bearing surfaces between the jaws and the journal boxes, to reduce the resulting gaps therebetween. In addition the fastener may be used with other liners of this type to improve their performance and achieve an improved fit of nylon liners on the pedestal legs.

OBJECTS OF THE INVENTION

It is an object of the present invention to produce a pedestal liner system employing an injected molded liner with thermoplastic wear strips of a higher resiliency than the liner positioned between the liner and the contacting face of the pedestal leg to provide increased resilience under load variations, and a novel mounting fastener, which allows the liner to slide on the sides of the leg to accommodate the resilience of the strips, in order to increase the life of the liner.

Another object of the present invention is the provision of a multi-piece pedestal liner system, with improved shock absorbing properties, which will reduce the amount of wear on the pedestal leg during service.

An additional object of the present invention is the production of a pedestal liner system with polyurethane inserts, which have improved shock absorbing properties relative to nylon, while still employing the strength of the nylon.

Still another object of the present invention is the provision of a novel attaching fastener member for attaching the pedestal liner to the pedestal leg.

Also, an object of the present invention is the provision of a pedestal liner system, which allows adjustments for worn truck systems by providing insert strips of different widths to accommodate situations where the significant wear has occurred between the jaw and the journal box in truck of railroad locomotives.

These, and other objects of the present invention, will become apparent from the description which follows and the drawings.

BRIEF DESCRIPTION OF THE DRAWINGS

In order to more completely describe the invention, reference is made to the accompanying drawings, wherein.

DETAILED DESCRIPTION OF THE INVENTION AND DRAWINGS

Figure 1:
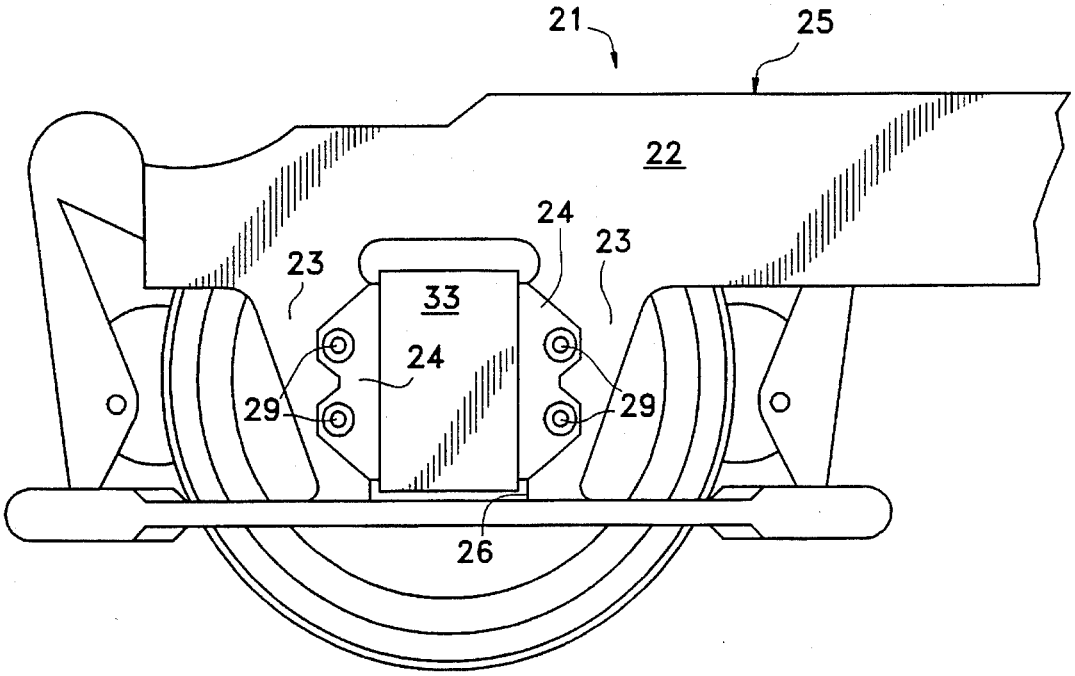
FIG. 1 is a side view, partially broken away, of a typical truck casting, illustrating the environment of the pedestal liner system of invention.

Referring to FIG, 1, a railroad truck 21, is illustrated of the pedestal type having jaws 22, and pedestal legs 23. Attached to the pedestal legs 23, are the pedestal liner systems 24, constructed according to this invention. The legs on opposite sides of the truck are connected by the truck casting 25. As can be seen in FIG. 1, the pedestal liner system fits on the opposing pedestal legs, which form an open jaw 26 of the truck.

Figure 2:
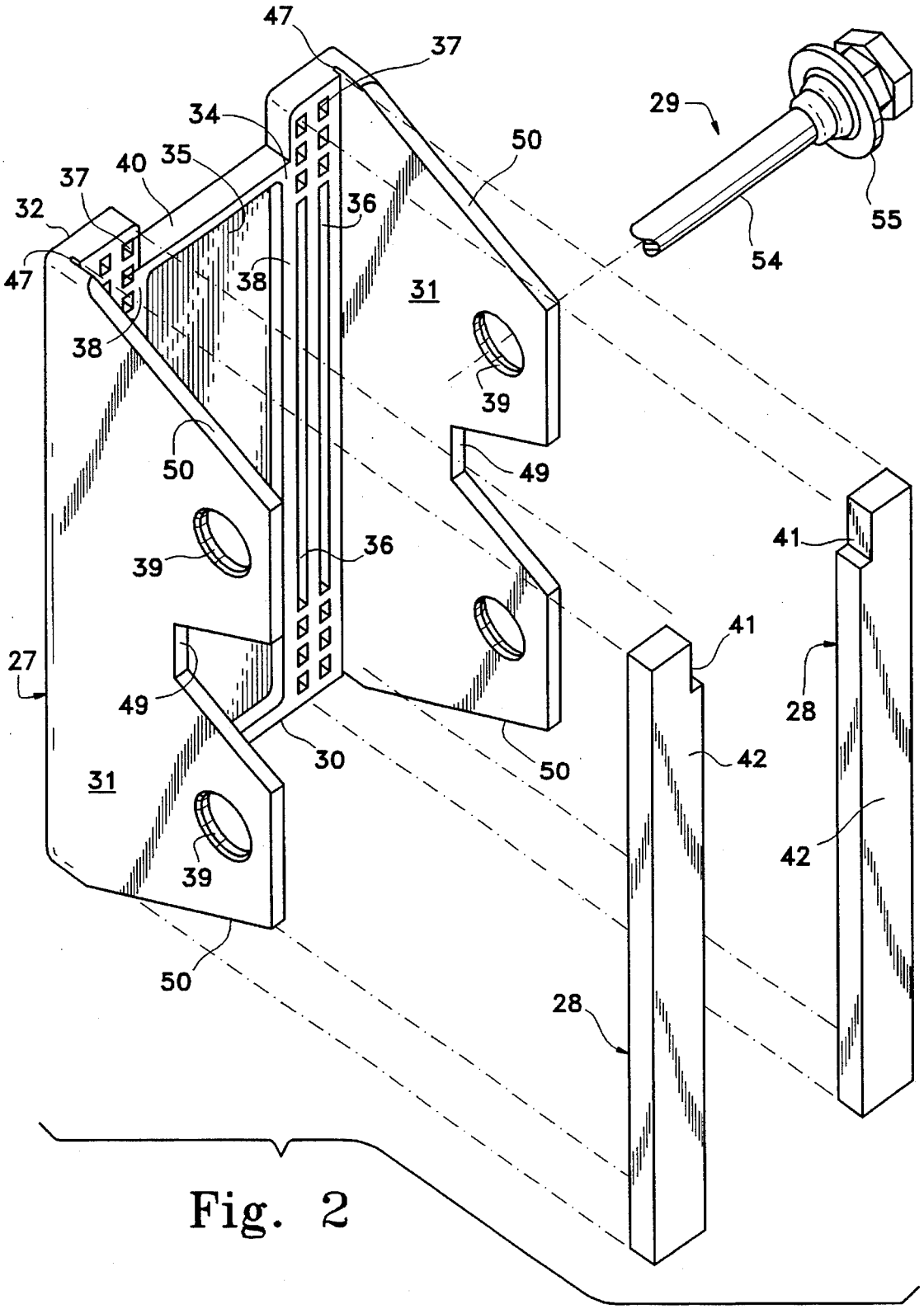
FIG. 2 is an exploded view of the pedestal liner system, with parts of the fastener broken away.

This pedestal liner system 24, best shown in FIG. 2, includes a liner unit 27, which is preferably an injection molded U-shaped unit, two thermoplastic inserts 28, and the attaching member or fastener 29 as its principal components.

This liner unit 27, is preferably composed of a monolithic part of injection molded nylon of the types hereinafter described. As indicated, it has a U-shaped channel member, with a rectangular base member 30, and two identical up standing side flanges 31, connected to the base at its opposite edges along its longitudinal axis, as illustrated in FIG. 2. The outer surface 32, of this base member forms the primary wear plate, which rubs against the journal box 33 when it is placed between the leg and the journal box, as can be seen in FIG. 1.

Between the side flanges 31, on the base member 30, of the liner unit 27, the inside surface 34, includes a series of reliefs of differing sizes. A large, rectangular relief 35, is centrally formed in the base member, as can been seen in FIG. 2, because the pedestal leg does not provide any support for the liner in this area. Adjacent to each flange in the base member are two, parallel longitudinal reliefs 36, at each end of which are a series of three pairs of box apertures 37, as shown in FIG. 2. The longitudinal relief and apertures together form a receptacle system or dowel system for the mating members on the inserts 28 to mechanically hold the inserts in place.

When the above described reliefs are fashioned in the inside surface 34, of the base member 30, two longitudinal mounting members 38, are left by the residual material of the base member, on which the inserts 28, are mounted. Parenthetically, the base member also includes a notch 40, to accommodate the spring saddle (not shown) mounted on top of each journal box 33. If the length of the liner unit 27, is decreased slightly, there is no need for this notch, as the interference with the spring saddle will then be avoided without any degradation of the pedestal liner system 24.

To retain the pedestal liner system on the pedestal leg 23, the flanges 31, are ported with apertures 39. As can be seen in FIG. 2, the fastener 29, is inserted into an aperture on one side of the liner unit 27, and passes through the corresponding aperture in the other flange. Of course the fastener is not inserted until the liner unit is fitted to the pedestal leg.

Figure 7:
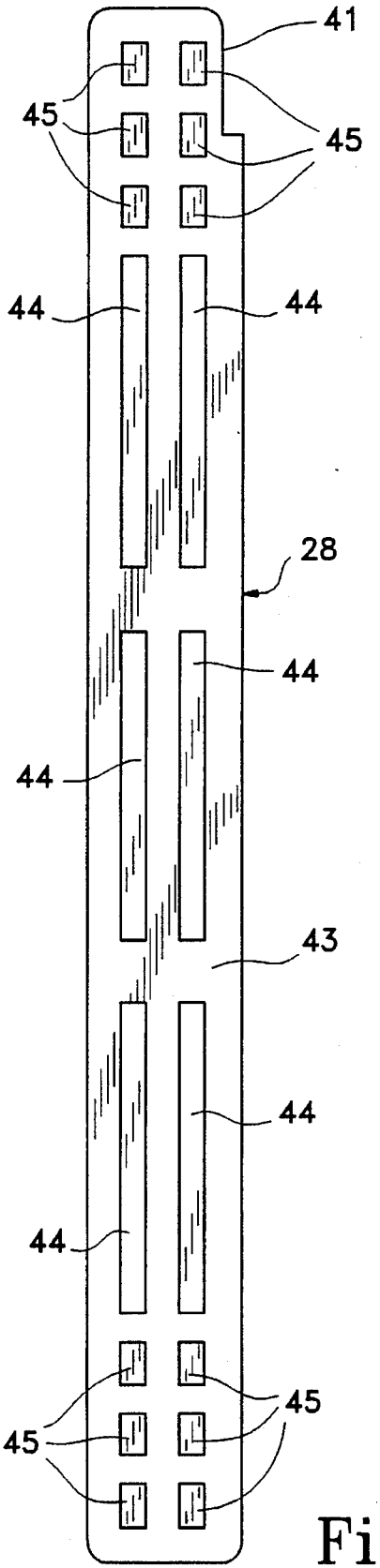
FIG. 7 is a plan view of one of the thermoplastic inserts, shown in FIG. 2.
Figure 8:
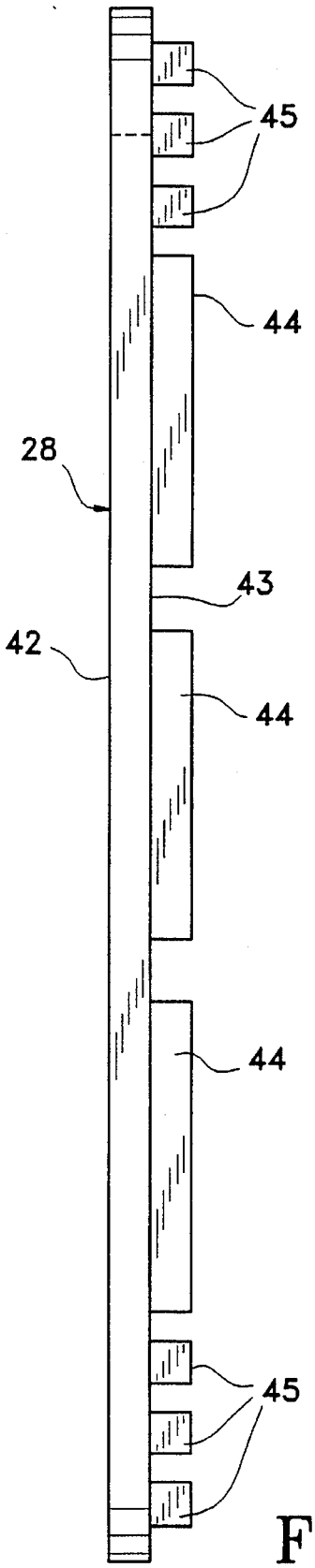
FIG. 8 is an edge view of the thermoplastic insert, shown in FIG. 7.

As to the physical construction of the thermoplastic inserts 28, it is best shown in FIGS. 2, 7 and 8. Each insert is identical, except one is a right and the other is a left, due to the notch 41, at their tops to mate with the notch 40, in the base member 30. The wear plate surface 42, is flat as can be seen in FIG. 2, while the mating surface 43, includes a series of projections, which are received in the reliefs formed in the associated mounting member 38, of the base member 30 to dowel these parts together.

While it is known that polyurethane forms an excellent wear plate, the material is too flexible to construct the entire liner from this material. Further it cannot be satisfactorily bonded with nylon, which is very suitable for the liner unit 27, with the available cements or solvents or welding. In view thereof, the mating surface of these inserts include a plurality of longitudinal keys 44, centrally disposed on this surface with a series of box keys 45, located at the ends of the longitudinal keys, see FIG. 8. These keys are received in the longitudinal and box reliefs formed in the mounting members 38, in the base members to hold the insert strips in place during service. While the key and relief attachment system shows the keys extending only part way through the base member, there is no reason the keys could not extend completely through the base member, which is a construction not shown in the drawings.

Figure 10:
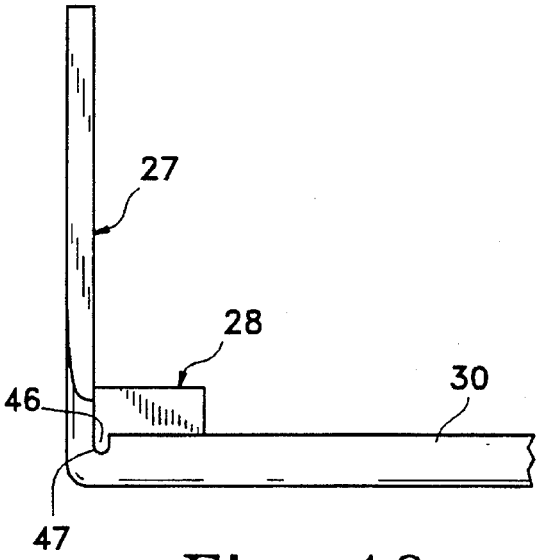
FIG. 10 is an end view of a thermoplastic insert and liner unit, such as the one shown in FIG. 7, which includes a small edge flange along the edge employed to lock it into the liner unit.
Figure 11:
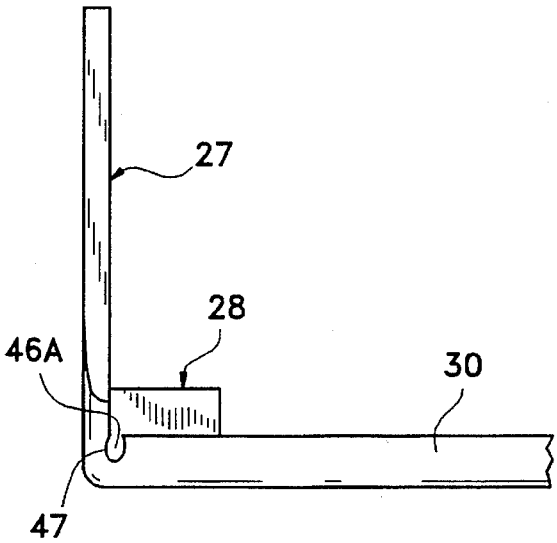
FIG. 11 is an end view of the thermoplastic insert and liner unit shown in FIG. 10, but with a key formed in the edge flange to better lock the strip in the liner unit of the system.

In addition to the longitudinal and box keys, 44 and 45, these strips can include a edge key 46, running along one of their edges as shown in FIG. 10. As it is desirable to form a lengthwise groove 47, where the side flanges 31, attach to the base member 30, to relieve some of the stresses, this groove can also serve to receive the edge key. When the flanges are fastened against the pedestal leg 23, the groove is collapsed very slightly, compressing the edge key when it is in place. Clearly, the groove may be changed in cross section to accommodate a dove tail type edge key 46A, as shown in FIG. 11.

Preferably these inserts 28, are formed of polyurethane strips; very satisfactory performance has been obtained using a urethane sold as Pellethane 21-90 AE® by DuPont to construct the inserts. For current tests, the channel-shaped liner unit 27 was constructed of 33 and ⅓ percent DuPont Zytel® 101 and 66⅔ percent of DuPont Zytel® ST801®, which are both thermoplastic resins sold by DuPont. Prior tests were run using nylon inserts, but trouble was experienced in securing the inserts to the liner unit in a manner which would retain them satisfactorily on the liner unit during service. However, using the reliefs in the liner unit and the keys, as described above, the retention of the polyurethane inserts proved satisfactory in actual service tests.

In respect to the inserts 28, since they are not formed as part of the liner unit 27, their thickness can be varied, so that on more worn trucks thicker inserts can be used to reduce the gaps in the area between the leg and the journal box. Also, the two spaced apart wear surfaces (not shown) of each pedestal leg 23, which mate with the inserts, have a bearing surface approximating the size and shape of the wear plate surface 42 on each insert. Thus there is no need to make the inserts wider (expanding them toward the center of the liner), as there would be no support for the enlarged width portion on the pedestal leg.

As indicated, the base member 30, includes two upstanding, parallel side flanges 31, along opposed edges as illustrated in FIG. 2, each of which side flange includes two spaced apart apertures 39, which are used to attach the liner unit to the pedestal leg 23, as shown in FIG. 1. Remote from their connection to the base member, each of these flanges include a large V-notch 49, between its apertures for the purpose of reducing the amount of nylon required to construct the liner unit 27, and also for relieving stresses in this area. For these same reasons the ends 50, of the flanges are relieved as they progress away from the base member 30.

Figure 9:
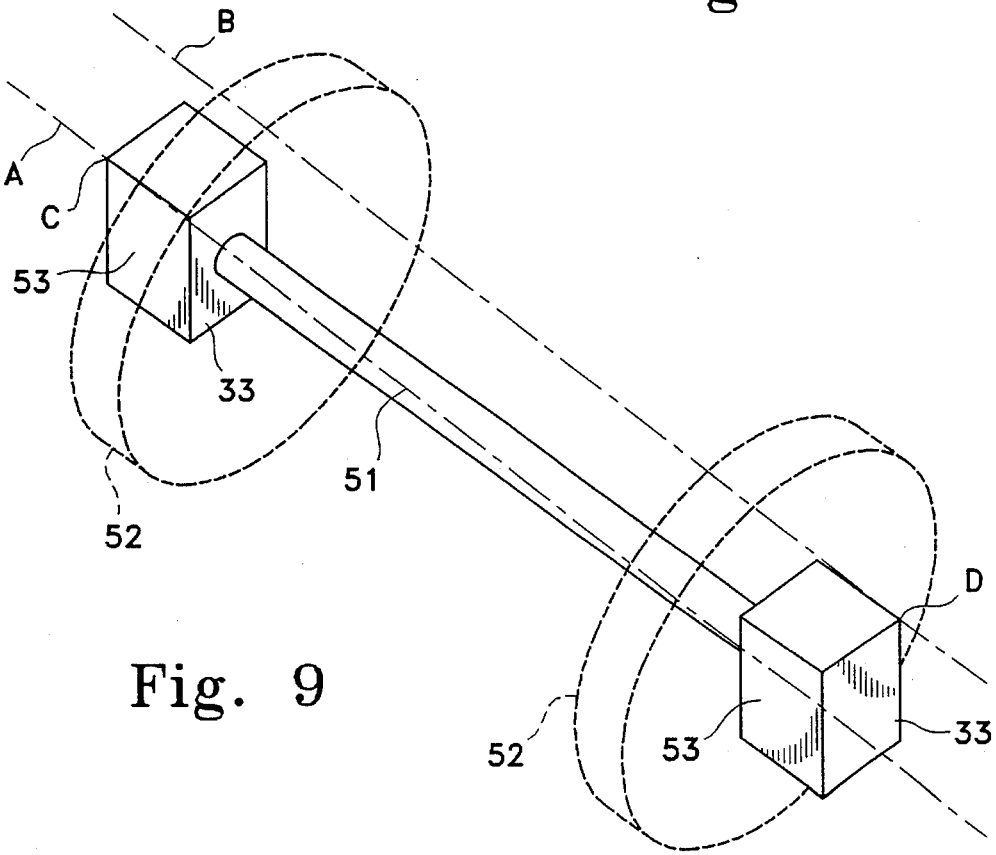
FIG. 9 is a graphic illustration of how the axle of the truck skews during the negotiation of a tight curve in the track.

To complete the system, the liner unit 27, with the inserts 28, in place, must be attached to the pedestal leg 23, in a manner to accommodate the resiliency of the inserts. To graphically illustrate the problem solved by the preferred technique of attachment of the liner unit to the pedestal leg, reference is made to FIG. 9. Therein, the axle 51, of the truck is illustrated with a journal box 33, at each end, along with the wheels 52, (shown phantom) which are permanently fixed to the axle. When the truck negotiates a relatively tight curve, the inside wheel will travel less distance than the outside wheel, however, since the wheels are fixed to the axle, one or the other wheel must slip on the track. As this slippage occurs, one of the journal boxes will be thrust forward and the other aft, which condition is referred herein as a skewed condition. This skewed condition, exaggerated for clarity, is illustrated by lines A and B in FIG. 9, wherein it can be seen that the resulting skew will cause the loadings to increase on the outside corners of the liner units at points C and D; this concentration of loading can lead to breakage of the liner unit. According to this invention, the pedestal liner system will slip on the sides of the pedestal leg 23, in a manner that the wear plate surface 32, of the liner unit 27, can re-orient by compressing the thermoplastic insert, so the increased loading becomes more uniformly distributed on the mating wear surface 53 of its contiguous journal box 33. Other types of concentrated loadings on the liner system will also be accommodated by the system of this novel invention.

The attachment required is provided by the attaching member or fastener 29, and its components, shown in FIGS. 3, 4, 5 and 6. As is illustrated in FIG. 2, the fastener is inserted through one of apertures 39, in one of the side flanges 31, passes through holes provided in the pedestal leg 23, and thence through the corresponding aperture in the other flange, to attach the liner unit 27, pedestal leg 23, as shown in FIG. 1. It is constructed of three parts, being a metal shaft 54, with a fixed nut 55, at one end of the shaft and a threaded nut 56, adapted to be screwed onto the opposite or threaded end 57 of the shaft.

Each of the nuts 55 and 56, are formed of a glass filled nylon. It has been found that a composition made by DuPont and sold as 6/12 (43% GR, NC) Zytel® 77G43L NCO10 is suitable for these parts. The end of the shaft 54, where the fixed nut is attached, is milled to provide configurations on the end of the shaft, which will retain the fixed nut and prevent relative rotation between the shaft and the fixed nut. Usually this type of connection can be accomplished by providing a plurality of flats and grooves in this end of the shaft, and then molding the fixed nut directly on this end of the shaft.

Figure 3:
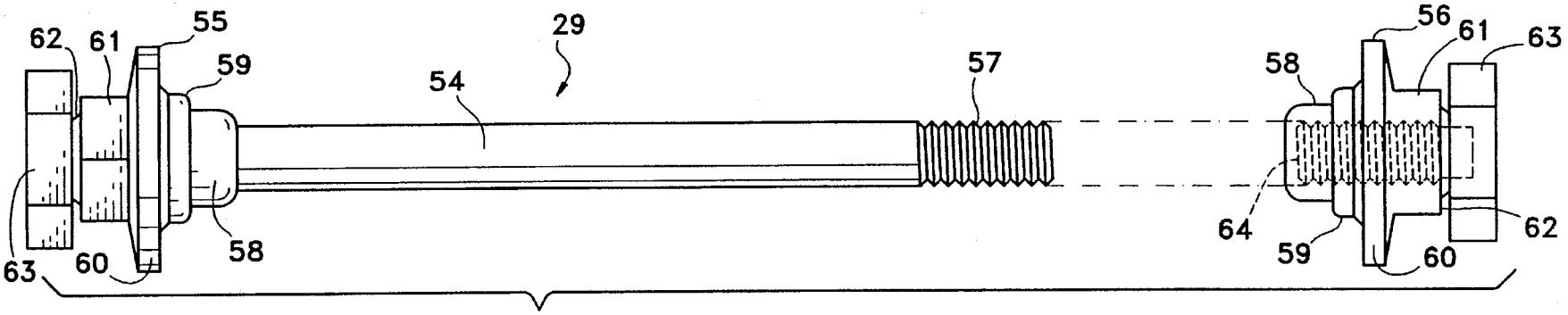
FIG. 3 is an elevation of the fastener with a nut exploded therefrom and with the threads in the nut indicated in phantom.
Figure 4:
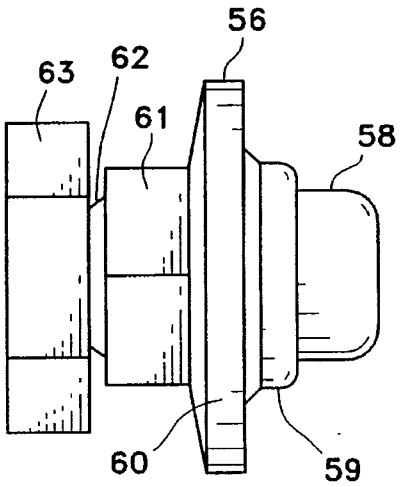
FIG. 4 is an elevation nut of the fastener, to show greater detail.

In all respects, except for their attachment to the shaft 54, the fixed nut 55, and the threaded nut 56, they have the same external configuration, as can be seen in FIGS. 3 and 4, whereby it will be only necessary to describe the threaded nut and its function.

Figure 6:
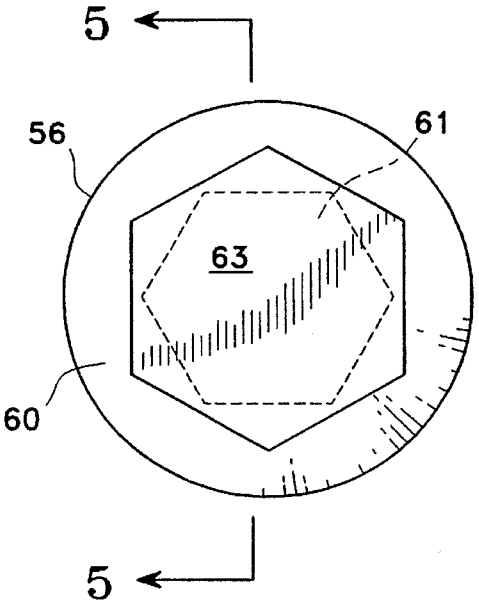
FIG. 6 is a section on the nut of the fastener, along line 5—5 of FIG. 5.
Figure 5:
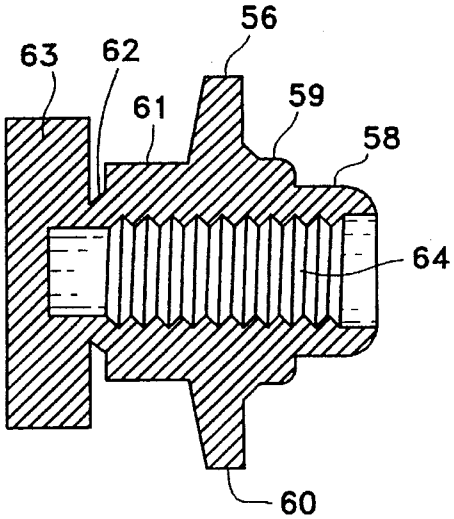
FIG. 5 is an end view of the nut of the fastener shown in FIG. 4.

FIGS. 4, 5 and 6 contain the best illustrations of the construction of the threaded nut 56. This monolithic nut, includes a centering boss 58, at one end adopted to fit into a bore on the pedestal leg 23. Centering is achieved by rounding or chamfering the end of this boss. A slightly larger mounting boss 59, and radial flange 60, form the central part of the nut. This mounting boss has a diameter of 1.234 inches compared to a diameter of 1.30 inches of the apertures 39, in the flanges 31 of the liner unit 27. Due to this difference in sizing, the liner unit 27, can articulate about the mounting boss. The radial flange on the nut is of a much larger diameter than the apertures in the side flanges and forms a large bearing surface around these apertures whereby the unit can move thereunder (see e.g., FIG. 2). Beyond the radial flange, toward the distal end of the nut, is an inner hex head 61, then a grove 62, and finally an outer hex head 63.

Hex head 61, and hex head 63, are constructed to receive wrenches or sockets, which are then used to tighten and loosen the fastener 29. In FIG. 6, it can be seen that the outer hex head is larger and circumferentially offset from the inner hex head, whereby a wrench or socket placed on the outer hex head cannot mate with the inner hex head. Groove 62 is critical and cut so that the outer hex head will break off the nut when a certain torque value occurs. In actual practice, the outer hex head separates from the nut at a torque of 70 foot pounds +/−5 foot pounds. Obtaining a uniform break off torque of the outer hex head required a long period of experimentation, involving the compositions, formulations and sizing of the groove 62. Further, it was found that the threaded end 57 of the shaft 54, had to be lubricated to obtain the uniform break off torques. For lubrication, the threaded end of the shaft is coated with Loctite® 200 DRI LOC made by Loctite Corporation. This compound is heated for 20 minutes at 155 degrees F. and then applied to an end portion of the threads on the shaft in a thin layer or coat, such as with a brush. The compound has granules of encapsulated epoxy components, which are broken when the threaded nut 56, is screwed on to the coated threaded end 57, of the shaft, where an epoxy "glue" is formed between treads of the bolt and the nut. As a result, this epoxy "glue" or filler will secure the threaded nut to the threads of the shaft so it will not back off; however, this filler is not so permanent that it will not prevent backing off the threaded nut to remove the fastener if sufficient torque is applied to the inner hex nut 61.

FIG. 6, a cross section, shows the threaded nut 56 has internal threads 64, which are formed when the nut is molded, usually by injection molding.

It can be appreciated that after the outer hex head 56, breaks away, that a purchase of wrench or a socket can be obtained on the inner, smaller hex head 61. Thus, the fastener 29, can be unscrewed to remove a broken or worn out pedestal liner unit 27, using the inner hex heads.

Figure 12:
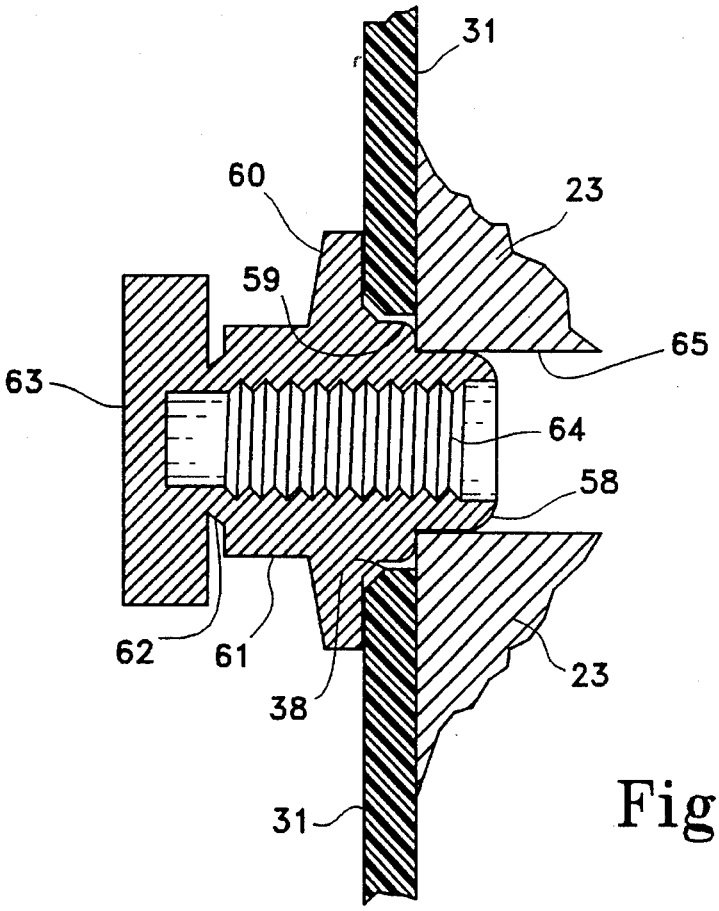
FIG. 12 is a sectional view of one end of the fastener, with parts of the pedestal jaw and liner unit broken away to better illustrate the arrangements used in attaching the unit to the pedestal jaw.

In FIG. 12 the configuration for attaching the pedestal liner system to the pedestal leg 23, is best illustrated. As can be seen in this drawing, the side flange 31, of the liner unit 27, is sandwiched between the radial flange 60, on the nut 56, and the pedestal leg 23, when the centering boss 28, enters the bore 65, in the leg. In this drawing, it can be seen that the mounting boss 59, has a larger diameter than the bore in the leg, and as result, its end abuts on the outside surface of the pedestal leg. As the wall thickness of the flange on the liner unit is 0.250 inches and the distance from the end of the mounting boss 58, and the radial flange 60, slightly less, the liner is fixedly secured on the side of the pedestal leg. Therefore, since the mounting boss 59, has a diameter less than the diameter of the apertures 39, in the side flanges 31, of the liner unit 27, this unit can articulate about the mounting boss under the radial flanges 60, of the nuts 55 and 56. In FIG. 12 a gap between the mounting boss and the aperture in the flange 31, can be seen which illustrates the clearances for the articulation described. By making the outer diameter of the mounting boss 1.235 inches, and the apertures in the side flanges 1.250 inches, the appropriate amount of articulation is achieved to enable the thermoplastic inserts 28, to compress and expand to improve the distribution of loading changes on the liner system.

Mechanics installing the novel system cannot be depended upon to properly torque the system, as a result, by controlling the break off torque of the fastener 29, it is not critical that the mounting boss provide a spacer for the liner thickness that prevents over torquing. With the torque controlled, the liner will always be able to slide under the radial flange 60, to achieve improved load distribution by such adjustment.

Using this novel system in actual tests on locomotives, it was found that the service life of the system can be in the range of 500,000 miles. By comparison, injection molded nylon pedestal liners typically have a service life of approximately 250,000 miles or slightly greater.

In a working embodiment of the present invention, the liner unit 27, has the following overall dimensions: length 14.5625 plus or minus 0.030 inches, width 7.500 inches plus 0.020 or minus 0.015 inches, and height 5.50 plus or minus 0.030 inches. The length and width of the pedestal liner assembly define the wear face of the liner element, which is 0.375 plus 0.010 or minus 0.005 inches in thickness. The length and height of this U-shaped unit are define the overall size of the flanges or mounting brackets, which are 0.250 plus 0.000 or minus 0.015 inches in thickness, have two holes 1.250 inches in diameter drilled after molding 6.50 inches apart, with their center about 1.25 inches from the outer edge (edge away from liner element), and have their outer corners clipped, removing a right triangular element from each of the outer corners with a long side about 3.5 inches along the length of the bracket, and a short side about 2.5 inches along the height of the bracket, the third side being the hypotenuse and the original outer corners forming the right angles of the triangles.

The inserts act as a shock absorber on impact, giving up to 0.065 inch, which reduces impact erosion of the pedestal leg and liner. Impact abrasion is a progressive wearing of the pedestal liner due to impact chipping or eroding the thermoplastic surface. When a suitable polyurethane insert is used, the shock absorber action improves the longevity of the nylon liner unit by reducing this action, as the polyurethane resins have more resilience than the nylon resins, which have been used for the pedestal liners in the past. Further, they have a higher coefficient of friction which reduces the relative motion in this area.

The preferred synthetic resinous material for the pedestal liner of this invention is nylon, although in some instances other plastic-like materials may be used. While nylons are preferred for the liner unit 27, nylons suitable for the liner units should have a compressive yield of strength above 8,000 to 10,000 pounds per square inch, polyurethanes are preferred for the inserts, due to their high strength, higher coefficient of friction, resiliency, and comparative freedom from corrosive attack in environments in which railroads are operated.

For the pedestal liner insert, the polyurethane is preferred to nylon because of its more resilient characteristics. Resins used in producing the pedestal liner and pedestal liner inserts of the present invention are injection molded grades, compounded with one or more of stabilizers, lubricants, plasticizers, reinforcements, and fillers.

Inserts 28, for the liner unit 27, may be produced by conventional injection molding techniques. Apertures 39, which the fastener 29, are formed in the flanges during the injection molding the channel-shaped unit.

In the present invention, the term nylon refers to the higher melting, fiber-forming polyamides. Of the more common of these, those useful in the practice of this invention may be mentioned polyhexamethylene adipamide (nylon 66), polyhexamethylene sebacamide (nylon 610), polymers prepared from 11-amino undecanoic acid, polymers prepared from higher lactams such as caprylactam and caprolactam (nylon 6), and copolymers, interpolymers and mixtures thereof. Newer nylon compounds, such as the Zytel® resins made by DuPont and sold as super tough nylons, are the preferred nylons.

It is apparent that the fundamental novel features of the present invention may also be applied in other situations, such as for fabricating, either in whole or in part, friction shoes, snubber wedges and journal box wear plates. In its broadest aspects, this invention contemplates the use of nylon surfaces with a more resilient insert to accommodate relative sliding movement between parts, subject to impact, and concentrated loadings of the type which occurs between component parts in railroad trucks.

While this specification, and accompanying drawings, describe and point out the fundamental novel features of the invention, as applied to the preferred embodiment, those skilled in the art will appreciate that various changes, modifications and omissions from the pedestal liner assembly may be made without departing from the spirit of the invention. It is the intention, therefore, to be limited only by the scope of the claims, and the doctrine of equivalents as applied thereto.

Having described my invention I claim:

1. An improved bearing system for locomotive trucks comprising:

a channel shaped means of a polymeric material having a rectangular base unit with an upstanding flange along each longitudinal edge, extending perpendicularly from said base unit;

two thermoplastic insert means of a material of a higher resiliency than the resiliency of said thermoplastic used for said base unit, one of said inserts being mounted on said base unit between and adjacent to each of said flanges so it is operable to be compressed under loading;

and attaching means cooperating with said upstanding flanges operable to mount said channel shaped means on a truck, said attaching means having tightening means associated therewith operable to release when a specified torque is applied thereon, whereby said channel shaped means is mounted by said attaching means on said truck in a manner that it can articulate under said attaching means allowing said insert means to compress and expand in service to better accommodate the distribution of the loadings when said system is mounted on a truck, thereby achieving improved service life of said system.

2. The improved bearing system defined in claim 1, wherein nylon materials are used to form the base unit and its flanges and polyurethane materials are used to form the insert means.

3. The improved bearing system defined in claim 1 wherein the insert means are mechanically connected to the base unit by dowel means on said insert means and cooperating recesses on said base unit operable to connect said insert means and base unit in a manner to prevent separation during service when compression and expansion thereof occurs.

4. The improved bearing system defined in claim 1 wherein the attaching means includes a shaft with a cap at each end both of said caps having an inner wrench surface and an outer wrench surface, with said outer wrench surface, being larger in diameter than said inner wrench surface and operable to prevent a socket wrench from engaging said inner wrench surface while said outer wrench surface is still attached to its cap and means between said inner and outer surfaces operable to cause said outer wrench to surface to separate from its cap when a specific torque is applied.

5. An improved attaching means for connecting bearing systems to railroad trucks comprising:

a bolt means having a shaft with a fixed cap at one end and removable cap at the other end threaded on said shaft; and both of said caps having an inner wrench surface and an outer wrench surface with said outer wrench surface being larger in diameter than said inner wrench surface, and a relief between said surfaces operable to allow said outer wrench surface to break off when a specified torque is applied thereon, said outer wrench surface also operable to prevent a socket wrench from engaging said inner wrench surface while said outer wrench surface is still attached to its cap.

6. The attaching means defined in claim 5 wherein the caps are formed of a reinforced nylon material.

7. The attaching means defined in claim 5 wherein each of the caps have a radial flange inside the wrench surfaces which flange has a diameter greater than the diameter of said surfaces and a tapered boss inside of said flange operable to align said attaching means when it's assembled on a structure where said caps are disposed on opposite sides of said structure.

8. An improved bearing system for locomotive trucks comprising:

a channel shaped means of a polymeric material having a rectangular base unit with an upstanding flange along each longitudinal edge, extending perpendicularly from said base unit;

two thermoplastic insert means of a material of a higher resiliency than the resiliency of said polymeric material used for said base unit, one of said inserts being mounted on said base unit between and adjacent to each of said flanges so each is operable to compress under loading;

and attaching means cooperating with said upstanding flanges operable to mount said channel shaped means on a truck, said attaching means having a bolt means having a shaft with a fixed cap at one end and removable cap at the other end threaded on said shaft and one of said caps having an inner wrench surface and an outer wrench surface and a relief between said surfaces operable to allow said outer wrench surface to separate when a specified torque is applied thereon, said outer wrench surface also operable to prevent a socket wrench from engaging said inner wrench surface while said outer wrench surface is still attached to its cap whereby under the specific torque of said attaching means said channel shaped means can articulate under said attaching means allowing said higher resiliency of said insert means through compression to better accommodate the distribution of the loadings when said system is mounted on a truck, thereby achieving improved service life of said system.

* * * * *

US005509359C1

(12) REEXAMINATION CERTIFICATE (4707th)

United States Patent

Houston

(10) Number: US 5,509,359 C1

(45) Certificate Issued: Jan. 7, 2003

(54) PEDESTAL LINER SYSTEM FOR LOCOMOTIVES

(75) Inventor: Stanley M. Houston, 930 Detroit Ave., Ste. A, Concord, CA (US) 94518

(73) Assignee: Stanley M. Houston, Concord, CA (US)

Reexamination Request:
No. 90/005,372, May 27, 1999

Reexamination Certificate for:

| | |
|---|---|
| Patent No.: | **5,509,359** |
| Issued: | **Apr. 23, 1996** |
| Appl. No.: | **08/304,831** |
| Filed: | **Sep. 13, 1994** |

(51) Int. Cl.[7] ..... B61F 5/32

(52) U.S. Cl. ..... 105/225; 411/3; 411/427

(58) Field of Search ..... 105/225

(56) References Cited

U.S. PATENT DOCUMENTS

| | | | | |
|---|---|---|---|---|
| 4,170,180 A | * | 10/1979 | Houston | 105/225 |
| 4,825,777 A | | 5/1989 | Cummins | 105/225 |
| 5,092,797 A | * | 3/1992 | Cole et al. | 439/783 |

FOREIGN PATENT DOCUMENTS

| | | | |
|---|---|---|---|
| DE | 2011739 | * | 3/1970 |

OTHER PUBLICATIONS

MTS Sales Brochure distributed by Modern Transportation Supplies, Inc. at the RSA Railway Trade Show held at the McCormick Center in Chicago, Illinois on Sep. 20, 1992.

* cited by examiner

*Primary Examiner*—Mark T. Le

(57) ABSTRACT

An improved sliding bearing system for railroad locomotives having pedestal legs includes a channel-shaped unit of a wear resistant thermoplastic, including a base and two upstanding flanges ported with mounting apertures, plus two inserts made of strips of a more resilient thermoplastic, with one of the inserts mounted in the base adjacent to one of the flanges and the other insert mounted in the base adjacent to the other flange, so they are operable to compress and expand under loading variations, along with fastening members with undersized bosses relative to the diameter of the apertures in the flanges, operable to secure the unit to the pedestal leg in a manner that its flanges will slip on the associated pedestal leg under loading variations to accommodate the resiliency of the inserts, enabling the unit to shift on the face of the leg to better distribute the loading on the unit more uniformly, whereby the service life of the unit is extended.

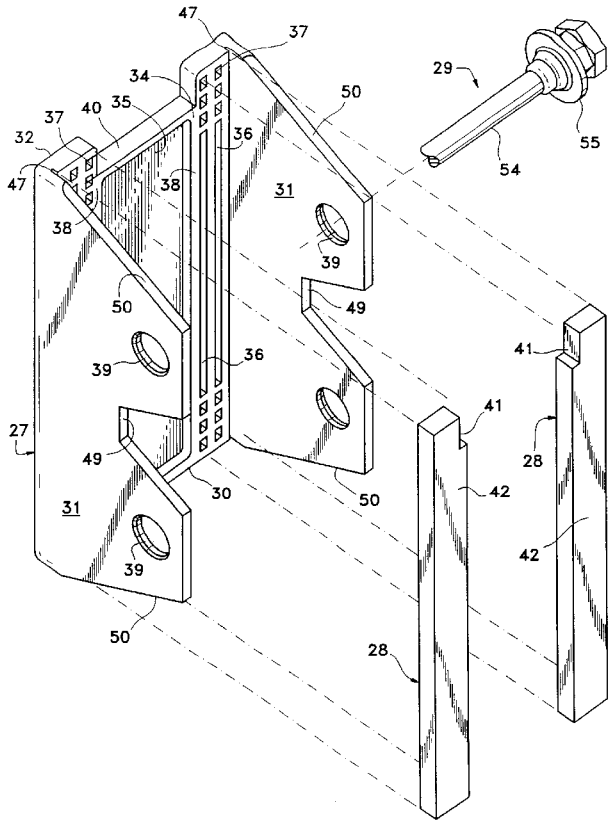

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–4 and 8 is confirmed.

Claims 5–7 are cancelled.

* * * * *